US011796168B1

(12) United States Patent
Yin

(10) Patent No.: US 11,796,168 B1
(45) Date of Patent: Oct. 24, 2023

(54) DECORATIVE DEVICE

(71) Applicant: Ruoxi Yin, Anhui (CN)

(72) Inventor: Ruoxi Yin, Anhui (CN)

( * ) Notice: Subject to any disclaimer, the term of this patent is extended or adjusted under 35 U.S.C. 154(b) by 0 days.

(21) Appl. No.: 18/182,445

(22) Filed: Mar. 13, 2023

(51) Int. Cl.
*F21V 33/00* (2006.01)
*F21W 121/00* (2006.01)
*F21Y 115/10* (2016.01)

(52) U.S. Cl.
CPC ..... *F21V 33/0028* (2013.01); *F21V 33/0056* (2013.01); *F21W 2121/00* (2013.01); *F21Y 2115/10* (2016.08)

(58) Field of Classification Search
CPC .. F21V 33/0028; F21V 33/0056; F21V 33/00; F21V 99/00; F21Y 2115/10; F21W 2121/00; H01K 7/06
See application file for complete search history.

(56) References Cited

U.S. PATENT DOCUMENTS

2012/0020076 A1* 1/2012 Leung ..... F21V 3/026 362/363
2016/0288008 A1* 10/2016 Wong ..... A63H 33/046

* cited by examiner

*Primary Examiner* — Bao Q Truong

(57) ABSTRACT

The present disclosure provides a decorative device. The decorative device includes a shell assembly. The shell assembly includes a plurality of blocks configured to be spliced to each other to form a predetermined modeling. The plurality of blocks includes a first block and a second block spliced with the first block. The first block includes a first main block and a first connection portion connected with the first main block. The second block includes a second main block. A first fixing portion is disposed on the first connection portion, a second fixing portion corresponding to the first fixing portion is disposed on the second main block, the second main block covers the first connection portion and the first fixing portion is configured to be fixed with the second fixing portion so as to connect the first block and the second block together.

16 Claims, 6 Drawing Sheets

DECORATIVE DEVICE

FIELD

The present disclosure relates to technical field of decorative devices, and more particularly to a decorative device with a plurality of splicing blocks.

BACKGROUND

Ornamental and decorative devices are commonly used to decorate residential and commercial buildings in accordance with a desired theme. For instance, during holiday seasons, buildings can be decorated with temporary decorations depicting snowmen, polar bears, Santa Claus, reindeer, and the like. Alternatively, buildings can be decorated with temporary white or multi-colored lights to promote a festive holiday atmosphere. Temporary decorations can also be used during other selected times of the year to accommodate a desired temporary theme. Alternatively, permanent decorations can be used for themes other than holiday or temporary themes. For instance, businesses can use colored lights to draw attention to services or products, or sporting events can use various ball-shaped decorations (e.g., a baseball) to promote games.

However, some decorative devices occupy a larger space, it is hard to storage and transportation.

SUMMARY

In order to overcome the disadvantage of the existing decorative devices, the present disclosure provides a decorative device with a plurality of splicing blocks.

The present disclosure provides a decorative device including a shell assembly, the shell assembly including a plurality of blocks configured to be spliced to each other to form a predetermined modeling, wherein the plurality of blocks includes a first block and a second block spliced with the first block, the first block includes a first main block and a first connection portion connected with the first main block, the second block includes a second main block, a first fixing portion is disposed on the first connection portion, a second fixing portion corresponding to the first fixing portion is disposed on the second main block, the second main block covers the first connection portion and the first fixing portion is configured to be fixed with the second fixing portion so as to connect the first block and the second block together.

In at least one embodiment, the first fixing portion is a first through hole passing through the first connection portion, the second fixing portion is a second through hole passing through the second main block, a first fastener element passes through the second through hole and is fixed at the first through hole so as to connect the first block and the second block together.

In at least one embodiment, the second block includes a second connection portion connected with the second main block, a third fixing portion is disposed on the first main block, a fourth fixing portion is disposed on the second connection portion, the first main block covers the second connection portion and the third fixing portion is configured to be fixed with the fourth fixing portion so as to further connect the first block and the second block together.

In at least one embodiment, the third fixing portion is a third through hole passing through the first main block, the fourth fixing portion is a fourth through hole passing through the second connection portion, a second fastener element passes through the third through hole and is fixed at the fourth through hole so as to further connect the first block and the second block together.

In at least one embodiment, each of the first fastener element and the second fastener element includes a head portion, a shaft connected with the head portion and a fastener portion connected with the shaft, a diameter of the head portion is greater than a diameter of the second through hole and a diameter of the third through hole, the shaft of the first fastener element is configured to pass through the first through hole and the second through hole, the head portion of the first fastener element is configured to be disposed at an outer surface of the second main block away from the first connection portion, the fastener portion of the first fastener element is configured to deform to pass though the first through hole and the second through hole and recover to be fixed at an inner surface of the first connection portion; the shaft of the second fastener element is configured to pass through the third through hole and the fourth through hole, the head portion of the second fastener element is configured to be disposed at an outer surface of the first main block away from the second connection portion, the fastener portion of the second fastener element is configured to deform to pass though the third through hole and the fourth through hole and recover to be fixed at an inner surface of the second connection portion.

In at least one embodiment, the fastener portion includes two elastic arms, the two elastic arms are located two opposite sides of the shaft, each elastic arm is bendable shaped and protrudes away from the shaft, a gap is located between each elastic arm and the shaft, an end of each elastic arm is connected to a side surface of the shaft, the other end of each elastic arm extends towards the head portion.

In at least one embodiment, an outer surface of the head portion away from the shaft is an arc-shaped surface, and a protruding direction of the arc-shaped surface is away from the shaft.

In at least one embodiment, each of the first main block and the second main block includes a plurality of plates, two adjacent plates are bendablely connected with each other.

In at least one embodiment, each plate is a flat plate, and the two adjacent plates are located at two different planes.

In at least one embodiment, the plurality of blocks are made of transparent plastic material, the decorative device further includes a lighting module and a control module electrically connected with the lighting module, the control module is configured to turn on or turn off the light module, and the lighting module is located in the shell and configured to emit light to pass through the plurality of blocks such that the decorative device is used as a night light.

In at least one embodiment, the lighting module includes wires and a plurality of LEDs electrically connected to each other via the wires, the wires are configured to be bent to different shapes by external force.

In at least one embodiment, the decorative device includes a sound module fixed on an outer surface of the shell and electrically connected with the control module, and the control module is configured to control the sound module play music based on a sound signal.

In at least one embodiment, the plurality of blocks are configured to be spliced to each other to form a bear-shaped modeling, the sound module has a heart-shaped modeling.

In at least one embodiment, the control module is further configured to control the LEDs shine according to the sound signal such that the LEDs shine accompanying the music.

In at least one embodiment, the decorative device includes a wireless module, the wireless module is electrically connected to the control module, the wireless module is configured to receive a control signal or the sound signal from an electronic device and provide the control signal or the sound signal to the control module, such that the control module controls the LEDs and the sound module according to the control signal or the sound signal.

In at least one embodiment, the wireless module is a bluetooth module, and the control signal is a bluetooth signal.

In at least one embodiment, the decorative device includes a sound sensing module, the sound sensing module is electrically connected to the control module, the sound sensing module is configured to sense a voice signal from a user and provide a sensing signal to the control module, such that the control module controls the LEDs and the sound module according to the sensing signal.

The present disclosure also provides a decorative device including a shell assembly, the shell assembly including a plurality of blocks configured to be detachably spliced to each other to form a predetermined modeling, wherein the plurality of blocks includes a first block and a second block adjacent to the first block, a first fastener element passes through a part of the first block and a part of the second block to detachably connect the first block and the second block together.

The decorative device provided by the present disclosure includes the plurality of blocks configured to be spliced to each other to form a predetermined modeling. Before splicing, it occupies a small space, and it is easy to storage, carry and transportation. Furthermore, users can splice the plurality of blocks to form the shell with the predetermined modeling to get enjoyment.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION

Figure 1:
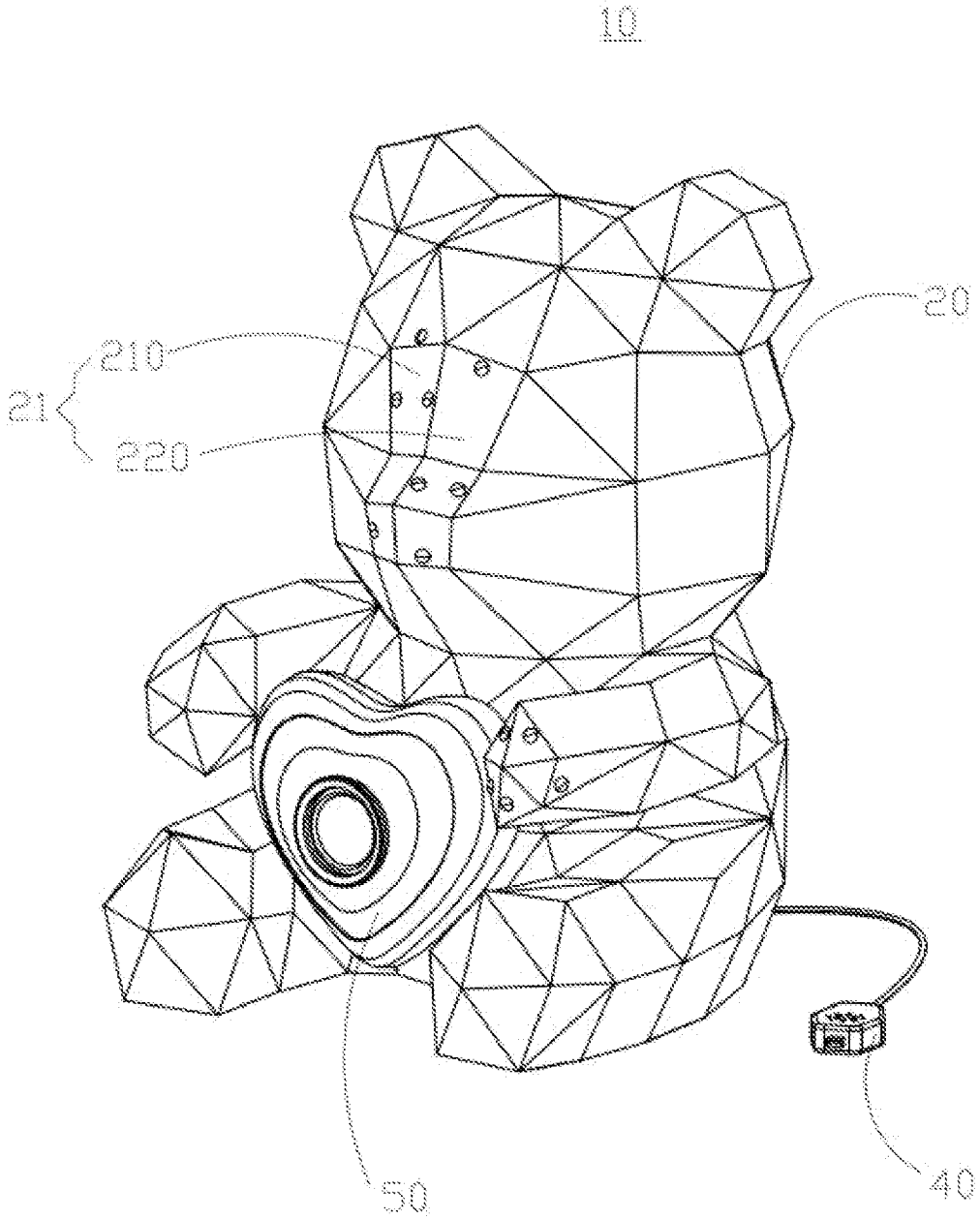
FIG. 1 is a schematic view of a decorative device according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the invention, "a plurality of" means two or more, unless otherwise specifically defined.

The terms "top", "bottom", and other indicating directions or positions are based on the directions or positions shown in the attached drawings in order to facilitate the description of the embodiment and simplify the description of the invention, rather than indicating or implying that the device or element referred to must have a specific orientation, be constructed and operated in a specific orientation, it cannot be understood as a limitation of the embodiment of the invention.

Figure 2:
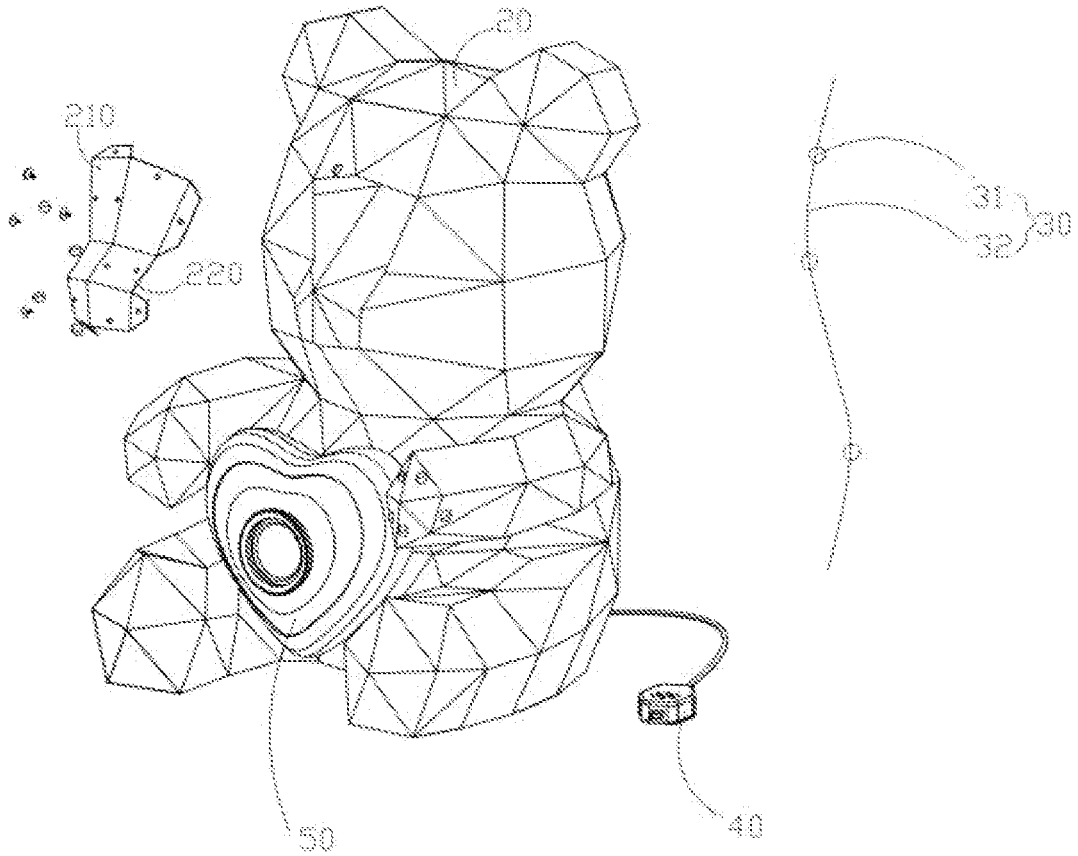
FIG. 2 is an exploded view of the decorative device of FIG. 1.
Figure 3:
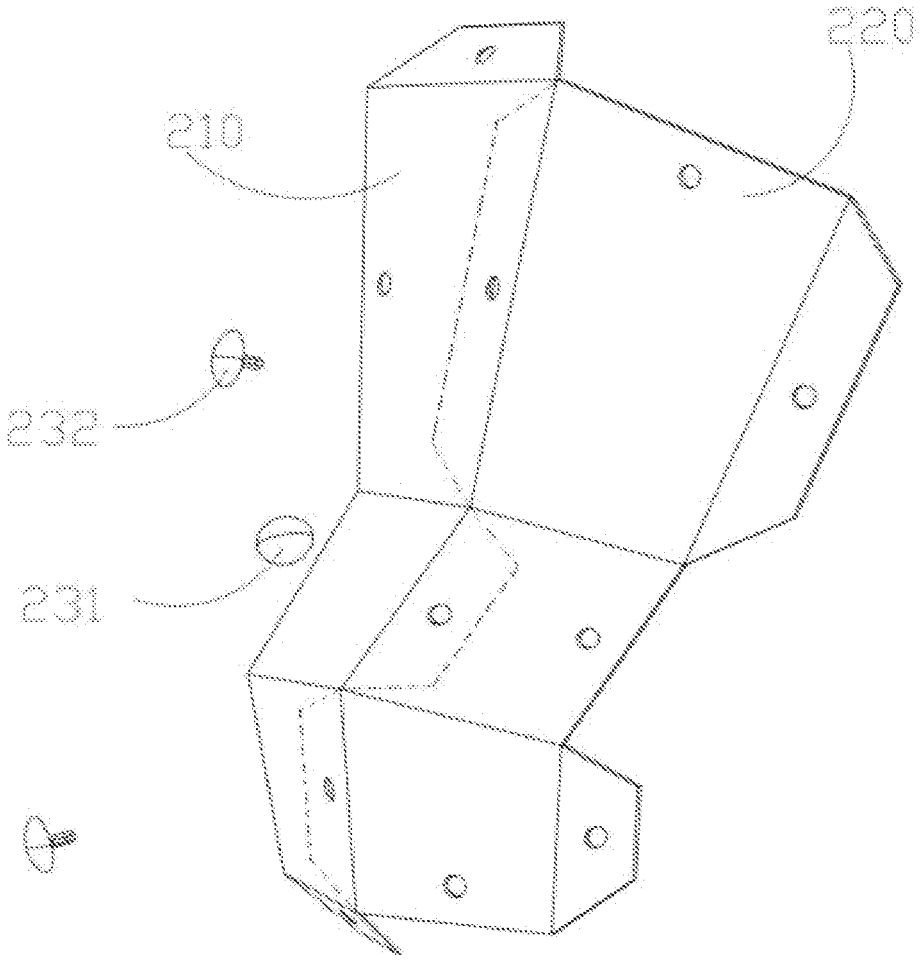
FIG. 3 is a schematic view of a part of the decorative device of FIG. 1.
Figure 4:
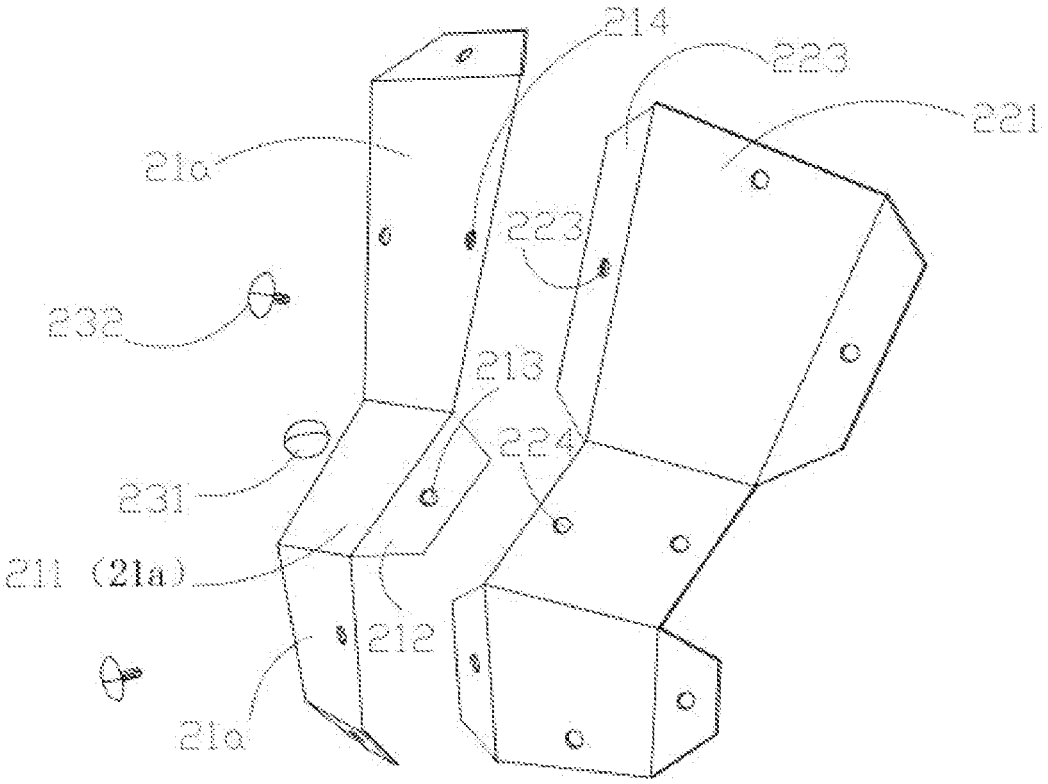
FIG. 4 is an exploded view of a first block, a second block and fastener elements of FIG. 3.
Figure 5:
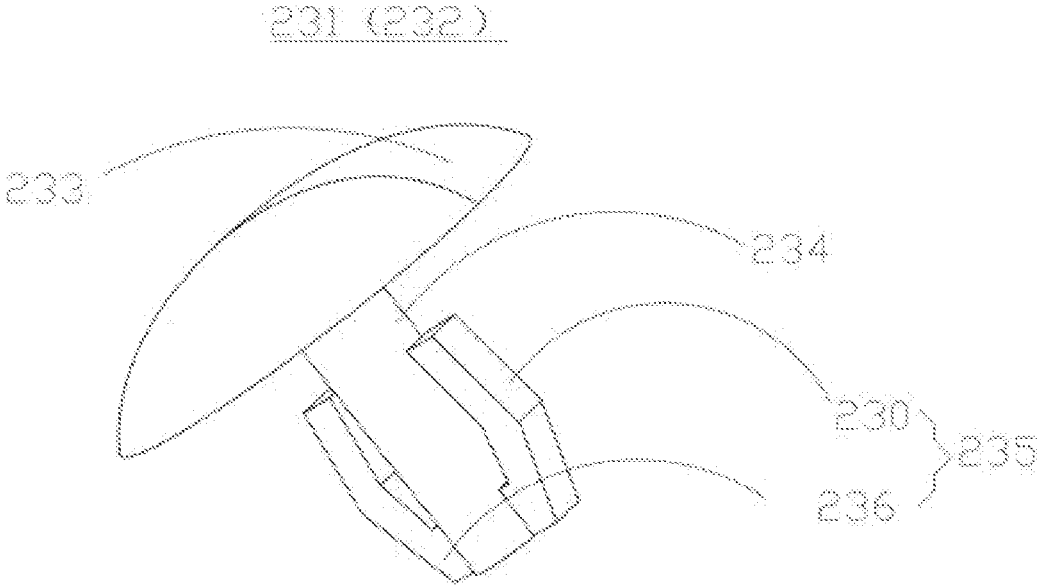
FIG. 5 is a schematic view of the fastener element of FIG. 4.
Figure 6:
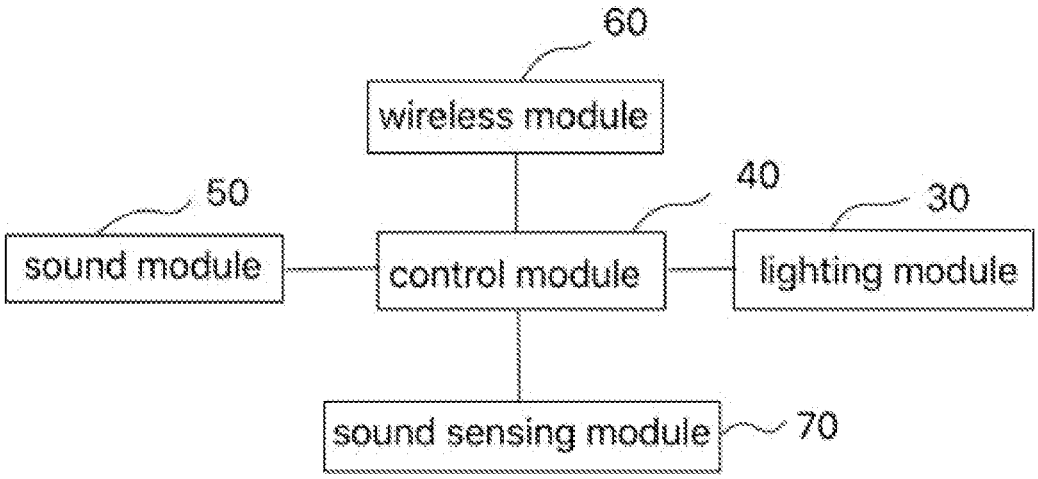
FIG. 6 is a circuit block diagram of the decorative device of FIG. 1.

Referring to FIGS. 1-2, an embodiment of the present disclosure provides a decorative device 10. The decorative device 10 includes a shell assembly 20, the shell assembly 20 including a plurality of blocks 21 (such as blocks 210 and 220) configured to be spliced to each other to form a predetermined modeling. However, there are only two spliced blocks 210 and 220 are shown in FIG. 1 and FIG. 2, however, it can be understood, in actual structure of the decorative device 10, all of the blocks 211 are like the blocks 210 and 220. In the embodiment, the plurality of blocks 21 are configured to be spliced to each other to form a bear-shaped modeling.

The plurality of blocks 21 includes a first block 210 and a second block 220 spliced with the first block 210. The first block includes a first main block 211 and a first connection portion 212 connected with the first main block 211. The second block 220 includes a second main block 221, a first fixing portion 213 is disposed on the first connection portion 212, a second fixing portion 223 corresponding to the first fixing portion 213 is disposed on the second main block 221. The second main block 221 covers the first connection portion 212, and the first fixing portion 213 is configured to be fixed with the second fixing portion 223 so as to connect the first block 210 and the second block 220 together.

The first fixing portion 213 is a first through hole passing through the first connection portion 212. The second fixing portion 223 is a second through hole passing through the second main block 221, A first fastener element 231 passes through the second through hole and is fixed at the first through hole so as to connect the first block 210 and the second block 220 together.

The second block 220 includes a second connection portion 222 connected with the second main block. A third fixing portion 214 is disposed on the first main block 213. A fourth fixing portion 224 is disposed on the second connection portion 223. The first main block 213 covers the second connection portion 222 and the third fixing portion 214 is configured to be fixed with the fourth fixing portion 224 so as to further connect the first block 210 and the second block 220 together.

The third fixing portion 214 is a third through hole passing through the first main block 211. The fourth fixing portion 224 is a fourth through hole passing through the second connection portion 223. A second fastener element 232 passes through the third through hole and is fixed at the fourth through hole so as to further connect the first block 210 and the second block 220 together.

Each of the first fastener element 231 and the second fastener element 232 includes a head portion 233, a shaft 234 connected with the head portion 233 and a fastener portion 235 connected with the shaft 234. A diameter of the head portion 233 is greater than a diameter of the second through hole and a diameter of the third through hole. The shaft 234 of the first fastener element 231 is configured to pass through the first through hole and the second through hole. The head portion 233 of the first fastener element 231 is configured to be disposed at an outer surface of the second main block 221 away from the first connection portion 212, the fastener portion 235 of the first fastener element 231 is configured to deform to pass though the first through hole and the second through hole and recover to be fixed at an inner surface of the first connection portion 212.

The shaft 234 of the second fastener element is configured to pass through the third through hole and the fourth through hole, the head portion 233 of the second fastener element 232 is configured to be disposed at an outer surface of the first main block 211 away from the second connection portion 222. The fastener portion 235 of the second fastener element 232 is configured to deform to pass though the third through hole and the fourth through hole and recover to be fixed at an inner surface of the second connection portion 222.

The fastener portion 235 includes two elastic arms 236, the two elastic arms 236 are located two opposite sides of the shaft 234. Each elastic arm 236 is bendable shaped and protrudes away from the shaft 234. A gap is located between each elastic arm 236 and the shaft 234. An end of each elastic arm 236 is connected to a side surface of the shaft 234, the other end of each elastic arm 236 extends towards the head portion 233.

An outer surface of the head portion 233 away from the shaft 234 is an arc-shaped surface, and a protruding direction of the arc-shaped surface is away from the shaft 234.

Each of the first main block 210 and the second main block 220 includes a plurality of plates 21*a*, two adjacent plates 21*a* are bendablely connected with each other. Each plate 21*a* is a flat plate, and the two adjacent plates 21*a* are located at two different planes. Furthermore, the first connection portion 212 is bendablely connected with the first main block 211, and the second connection portion 222 is bendablely connected with the second main block 221.

The plurality of blocks 21*a* (including the first block 210 and the second block 220) are made of transparent plastic material. The decorative device 10 further includes a lighting module 30 and a control module 40 electrically connected with the lighting module 30. The control module 40 is configured to turn on or turn off the light module 30, and the lighting module 30 is located in the shell 20 and configured to emit light to pass through the plurality of blocks 21*a* such that the decorative device 10 is used as a night light.

The lighting module 30 includes wires and a plurality of LEDs 31 electrically connected to each other via the wires 32, the wires 32 are configured to be bent to different shapes by external force from a user's hands.

The decorative device 10 includes a sound module 50 fixed on an outer surface of the shell 20 and electrically connected with the control module 40, and the control module 40 is configured to control the sound module 50 play music based on a sound signal. In the embodiment, the sound module 50 has a heart-shaped modeling The control module 40 is further configured to control the LEDs 31 shine according to the sound signal such that the LEDs 31 shine accompanying the music.

The decorative device 10 includes a wireless module 60. The wireless module is electrically connected to the control module 40. The wireless module 60 is configured to receive a control signal or the sound signal from an electronic device (such as a phone) and provide the control signal or the sound signal to the control module 40, such that the control module 40 controls the LEDs 31 and the sound module 50 according to the control signal or the sound signal.

In the embodiment, the wireless module 60 is a bluetooth module, and the control signal is a bluetooth signal.

The decorative device 10 may further include a sound sensing module 70. The sound sensing module 70 is electrically connected to the control module 40. The sound sensing module 70 is configured to sense a voice signal from a user and provide a sensing signal to the control module 40, such that the control module 40 controls the LEDs 31 and the sound module 50 according to the sensing signal.

The decorative device 10 provided by the present disclosure includes the plurality of blocks 21 configured to be spliced to each other to form a predetermined modeling. Before splicing, it occupies a small space, and it is easy to storage, carry and transportation. Furthermore, the first block 210 and the second block 220 can be spliced together easily by the first fastener element 231 and the second fastener element 232, thus, users can splice the plurality of blocks 21 to form the shell 20 with the predetermined modeling and get enjoyment.

It is to be understood, even though information and advantages of the present exemplary embodiments have been set forth in the foregoing description, together with details of the structures and functions of the present exemplary embodiments, the disclosure is illustrative only. Changes may be made in detail, especially in matters of shape, size, and arrangement of parts within the principles of the present exemplary embodiments to the full extent indicated by the plain meaning of the terms in which the appended claims are expressed.

What is claimed is:

1. A decorative device, comprising a shell assembly, the shell assembly comprising a plurality of blocks configured to be spliced to each other to form a predetermined modeling, wherein the plurality of blocks comprises a first block and a second block spliced with the first block, the first block comprises a first main block and a first connection portion connected with the first main block, the second block comprises a second main block, a first fixing portion is disposed on the first connection portion, a second fixing portion corresponding to the first fixing portion is disposed on the second main block, the second main block covers the first connection portion and the first fixing portion is configured to be fixed with the second fixing portion so as to connect the first block and the second block together, wherein the first fixing portion is a first through hole passing through the first connection portion, the second fixing portion is a second through hole passing through the second main block, a first fastener element passes through the second through hole and is fixed at the first through hole so as to connect the first block and the second block together.

2. The decorative device according to claim 1, wherein the second block comprises a second connection portion connected with the second main block, a third fixing portion is disposed on the first main block, a fourth fixing portion is disposed on the second connection portion, the first main block covers the second connection portion and the third fixing portion is configured to be fixed with the fourth fixing portion so as to further connect the first block and the second block together.

3. The decorative device according to claim 2, wherein the third fixing portion is a third through hole passing through the first main block, the fourth fixing portion is a fourth through hole passing through the second connection portion, a second fastener element passes through the third through hole and is fixed at the fourth through hole so as to further connect the first block and the second block together.

4. The decorative device according to claim 3, wherein each of the first fastener element and the second fastener element comprises a head portion, a shaft connected with the head portion and a fastener portion connected with the shaft, a diameter of the head portion is greater than a diameter of the second through hole and a diameter of the third through hole, the shaft of the first fastener element is configured to pass through the first through hole and the second through hole, the head portion of the first fastener element is configured to be disposed at an outer surface of the second main block away from the first connection portion, the fastener portion of the first fastener element is configured to deform to pass though the first through hole and the second through hole and recover to be fixed at an inner surface of the first connection portion;

the shaft of the second fastener element is configured to pass through the third through hole and the fourth through hole, the head portion of the second fastener element is configured to be disposed at an outer surface of the first main block away from the second connection portion, the fastener portion of the second fastener element is configured to deform to pass though the third through hole and the fourth through hole and recover to be fixed at an inner surface of the second connection portion.

5. The decorative device according to claim 4, wherein the fastener portion comprises two elastic arms, the two elastic arms are located two opposite sides of the shaft, each elastic arm is bendable shaped and protrudes away from the shaft, a gap is located between each elastic arm and the shaft, an end of each elastic arm is connected to a side surface of the shaft, the other end of each elastic arm extends towards the head portion.

6. The decorative device according to claim 5, wherein an outer surface of the head portion away from the shaft is an arc-shaped surface, and a protruding direction of the arc-shaped surface is away from the shaft.

7. The decorative device according to claim 5, wherein each of the first main block and the second main block comprises a plurality of plates, two adjacent plates are bendablely connected with each other.

8. The decorative device according to claim 7, wherein each plate is a flat plate, and the two adjacent plates are located at two different planes.

9. The decorative device according to claim 1, wherein the plurality of blocks are made of light-transmitting material, the decorative device further comprises a lighting module and a control module electrically connected with the lighting module, the control module is configured to turn on or turn off the light module, and the lighting module is located in the shell and configured to emit light to pass through the plurality of blocks such that the decorative device is used as a night light.

10. The decorative device according to claim 9, wherein the lighting module comprises wires and a plurality of LEDs electrically connected to each other via the wires, the wires are configured to be bent to different shapes by external force.

11. The decorative device according to claim 9, wherein the decorative device comprises a sound module fixed on an outer surface of the shell and electrically connected with the control module, and the control module is configured to control the sound module play music based on a sound signal.

12. The decorative device according to claim 11, wherein the plurality of blocks are configured to be spliced to each other to form a bear-shaped modeling, the sound module has a heart-shaped modeling.

13. The decorative device according to claim 12, wherein the control module is further configured to control the LEDs shine according to the sound signal such that the LEDs shine accompanying the music.

14. The decorative device according to claim 12, wherein the decorative device comprises a wireless module, the wireless module is electrically connected to the control module, the wireless module is configured to receive a control signal or the sound signal from an electronic device and provide the control signal or the sound signal to the control module, such that the control module controls the LEDs and the sound module according to the control signal or the sound signal.

15. The decorative device according to claim 14, wherein the wireless module is a bluetooth module, and the control signal is a bluetooth signal.

16. The decorative device according to claim 12, wherein the decorative device comprises a sound sensing module, the sound sensing module is electrically connected to the control module, the sound sensing module is configured to sense a voice signal from a user and provide a sensing signal to the control module, such that the control module controls the LEDs and the sound module according to the sensing signal.

* * * * *